US011211717B2

(12) United States Patent
Shen et al.

(10) Patent No.: US 11,211,717 B2
(45) Date of Patent: Dec. 28, 2021

(54) PCB ANTENNA

(71) Applicant: AAC Technologies Pte. Ltd., Singapore (SG)

(72) Inventors: Yachuan Shen, Shenzhen (CN); Lei Zheng, Shenzhen (CN); Yongsheng Peng, Shenzhen (CN); Hongjun Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 5 days.

(21) Appl. No.: 16/945,947

(22) Filed: Aug. 3, 2020

(65) Prior Publication Data

US 2020/0412016 A1 Dec. 31, 2020

Related U.S. Application Data

(63) Continuation of application No. PCT/CN2019/093495, filed on Jun. 28, 2019.

(51) Int. Cl.

| | |
|---|---|
| ***H01Q 1/38*** | (2006.01) |
| ***H01Q 11/14*** | (2006.01) |
| ***H01Q 21/06*** | (2006.01) |
| ***H01Q 5/50*** | (2015.01) |
| ***H01Q 5/371*** | (2015.01) |
| ***H01Q 23/00*** | (2006.01) |

(52) U.S. Cl.

CPC ..... *H01Q 21/064* (2013.01); *H01Q 1/38* (2013.01); *H01Q 5/371* (2015.01); *H01Q 5/50* (2015.01); *H01Q 11/14* (2013.01); *H01Q 23/00* (2013.01)

(58) Field of Classification Search

CPC ..... H01Q 5/371; H01Q 5/50; H01Q 9/0407

See application file for complete search history.

(56) References Cited

U.S. PATENT DOCUMENTS

2004/0183727 A1* 9/2004 Choi ..... H01Q 5/371 343/700 MS

2021/0143552 A1* 5/2021 Shao ..... H01Q 5/371

* cited by examiner

*Primary Examiner* — Ricardo I Magallanes

(74) *Attorney, Agent, or Firm* — W&G Law Group

(57) ABSTRACT

Provided is a PCB antenna, including a PCB substrate, first and second radiating portions, the first radiating portion includes a first radiator, second and third radiators extending therefrom to form a feeding groove, and first and second openings provided on the second and third radiators; the second radiating portion includes a fourth radiator and fifth and sixth radiators extending therefrom, a seventh radiator and eighth and ninth radiators extending therefrom, tenth and eleventh radiators symmetrically extending from the fourth radiator to the seventh radiator; the tenth and eleventh radiators extend towards the first radiating portion to form twelfth and thirteenth radiators, and form third and fourth slots with the second and third radiators; the fifth radiator extends to the feeding groove. The PCB antenna provided by the present invention can enhance the medium and high frequency resonance and provide antenna design in a frequency band of 5G-Sub6G.

12 Claims, 11 Drawing Sheets farfield (f=0.9) [1]
Type Farfield
Approximation enabled (kR >> 1)
Component Abs
Output Directivity
Frequency 0.9 GHz
Rad. effic. -0.1386 dB
Tot. effic. -0.1696 dB
Dir. 1.695 dBi farfield (f=2.01) [1]
Type Farfield
Approximation enabled (kR >> 1)
Component Abs
Output Directivity
Frequency 2.01 GHz
Rad. effic. -0.2917 dB
Tot. effic. -1.323 dB
Dir. 4.127 dBi

PCB ANTENNA

TECHNICAL FIELD

The present invention relates to the field of communication technology and, in particular, to a PCB antenna.

BACKGROUND

With the continuous development of computer technology and communication technology, a variety of customer premise equipment (CPE) has appeared in consumers' daily life, and coverage of functions thereof is becoming more and more comprehensive. With the continuous universalization of the functions, consumers' demands for communication are also increasing, for example, demands for antenna performances are increasing. In the related technical solutions, a frequency band of the antenna that can be used for terminal device such as a CPE or a router is narrow, and it is only suitable for antenna demands in one certain frequency band. However, in practical applications, the related terminal device has a very urgent demand for a full-frequency band omnidirectional antenna under frequency bands of 5G and Sub-6G.

That is to say, there is a lack of full-frequency band omnidirectional antennas in the frequency bands of 5G and Sub-6G in the related technical solutions to meet users' requirements on antenna of terminal device such as the CPE and the router.

Therefore, it is necessary to design a full-frequency band omnidirectional antenna in the frequency bands of 5G and Sub-6G.

SUMMARY

An object of the present invention is to provide a PCB antenna to meet the full-frequency band omnidirectional antenna requirements in the frequency bands of 5G and Sub-6G.

The technical solution of the present invention is as follows:

A PCB antenna, including: a PCB substrate; a first radiating portion provided on the PCB substrate; a second radiating portion provided on the PCB substrate, the first radiating portion includes a first radiator, a second radiator extending from the first radiator and a third radiator extending from the first radiator, the second radiator and the third radiator are arranged symmetrically with respect to an axis of the first radiator in a first direction, a feeding groove is formed between the second radiator and the third radiator, and the first direction is a direction in which the second radiator extends relative to the first radiator; a side of the second radiator facing away from the first radiator is provided with a first opening, and a side of the third radiator facing away from the first radiator is provided with a second opening;

the second radiating portion includes a fourth radiator, a fifth radiator extending from the fourth radiator and a sixth radiator extending from the fourth radiator, and the fifth radiator extends to the feeding groove, and a first slot is formed between the fifth radiator and the first radiator; and the sixth radiator extends in a direction opposite to a direction in which the fifth radiator extends;

the second radiating portion further includes a seventh radiator, an eighth radiator extending from the seventh radiator and a ninth radiator extending from the seventh radiator, the seventh radiator extends in the direction in which the sixth radiator extends, and a second slot is formed between the seventh radiator and the sixth radiator; and the eighth radiator extends in a direction opposite to the direction in which the seventh radiator extends;

the second radiating portion further includes a tenth radiator and an eleventh radiator that extend from a side of the fourth radiator close to the second radiator and beyond the seventh radiator and are symmetrically arranged with respect to the axis of the first radiator in the first direction, and the tenth radiator and the eleventh radiator are connected to the fourth radiator and the seventh radiator; and the second radiator further includes a twelfth radiator extending from the tenth radiator in a direction opposite to the first direction, and a thirteenth radiator extending from the eleventh radiator in the direction opposite to the first direction; and a third slot is formed between the twelfth radiator and the second radiator, and a fourth slot is formed between the thirteenth radiator and the third radiator.

As an improvement, a width of the third slot and a width of the fourth slot both range from 2.2 mm to 2.7 mm.

As an improvement, operating frequency bands of the PCB antenna are 790-960 MHz, 1710-2690 MHz, 3.3-3.6 GHz and 4.8-5 GHz.

As an improvement, a third opening is provided at a side of the tenth radiator close to the fifth radiator and facing towards the fourth radiator, and a fourth opening is provided at a side of the eleventh radiator close to the fifth radiator and facing towards the fourth radiator, and sides of the third opening and the fourth opening away from the first radiator are aligned with a side of the sixth radiator facing away from the fifth radiator; and a fifth opening is provided at a side of the tenth radiator facing away from the seventh radiator, and a sixth opening is provided at a side of the eleventh radiator facing away from the seventh radiator.

As an improvement, the antenna further includes a feeder port provided in the first slot.

As an improvement, the feeder port includes one end connected to the first radiator and the other end connected to the fifth radiator.

As an improvement, the feeder port is a coaxial feeder port.

As an improvement, a size of the PCB substrate is 124.65 mm×27.02 mm.

As an improvement, a slot width of the first slot is 2.25 mm, and a dimension of the fifth radiator in a perpendicular direction of the first direction is 1 mm.

As an improvement, a dimension of the fifth radiator in a direction perpendicular to the first direction is smaller than a dimension of the sixth radiator in the direction perpendicular to the first direction; a dimension of the sixth radiator in the direction perpendicular to the first direction is 8.02 mm; and dimensions of the eighth radiator and the ninth radiator in the first direction are 7.02 mm; and a dimension of the fourth radiator in the first direction is smaller than a dimension of the seventh radiator in the first direction.

The beneficial effects of the present invention lie in:

The PCB antenna provided by the embodiments of the present invention includes a PCB substrate, and a first radiating portion and a second radiating portion that are provided on the PCB substrate; the first radiating portion includes a first radiator, a second radiator extending from the first radiator and a third radiator extending from the first radiator, the second radiator and the third radiator are arranged symmetrically with respect to an axis of the first radiator in a first direction, a feeding groove is formed between the second radiator and the third radiator, and the first direction is a direction in which the second radiator extends relative to the first radiator; a side of the second radiator facing away from the first radiator is provided with a first opening, and a side of the third radiator facing away from the first radiator is provided with a second opening; the second radiating portion includes a fourth radiator, a fifth radiator extending from the fourth radiator and a sixth radiator extending from the fourth radiator, and the fifth radiator extends to the feeding groove, and a first slot is formed between the fifth radiator and the first radiator; and the sixth radiator extends in a direction opposite to a direction in which the fifth radiator extends; the second radiating portion further includes a seventh radiator, an eighth radiator extending from the seventh radiator and a ninth radiator extending from the seventh radiator, the seventh radiator extends in the direction in which the sixth radiator extends, and a second slot is formed between the seventh radiator and the sixth radiator; and the eighth radiator extends in a direction opposite to the direction in which the seventh radiator extends; the second radiating portion further includes a tenth radiator and an eleventh radiator that extend from a side of the fourth radiator close to the second radiator and beyond the seventh radiator and are symmetrically arranged with respect to the axis of the first radiator in the first direction, and the tenth radiator and the eleventh radiator are connected to the fourth radiator and the seventh radiator; and the second radiator further includes a twelfth radiator extending from the tenth radiator in a direction opposite to the first direction, and a thirteenth radiator extending from the eleventh radiator in the direction opposite to the first direction; and a third slot is formed between the twelfth radiator and the second radiator, and a fourth slot is formed between the thirteenth radiator and the third radiator.

Adopting the PCB antenna provided by the present invention, signal radiation of multiple frequency bands under the frequency bands of 5G and Sub-6G can be achieved through the radiation between the plurality of radiators, adopting horizontal or vertical radiator arrangement and slots and grooves when arranging the radiators improves the convenience of the PCB antenna in the processing process, and adopting the compact structure arrangement reduces the overall dimension of the PCB antenna and reduces demand for an antenna area. In addition, through the coupling distance between the third slot and the fourth slot, the resonance performance of the PCB antenna at medium and high frequencies is enhanced, to improve the antenna performance and realize the signal radiation in multiple frequency bands under the frequency bands of 5G and Sub-6G.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The present invention will be further illustrated with reference to the accompanying drawings and the embodiments.

In the present invention, a PCB antenna is provided. The antenna has a multi-band function, can realize signal radiation in frequency bands of 790-960 MHz, 1710-2690 MHz, 3.3-3.6 GHz and 4.8-5 GHz under the frequency band of 5G, and covers signal radiation in the frequency band of 5G-Sub6G.

Referring to FIGS. 1-4, a schematic diagram of a PCB antenna is shown.

The PCB antenna 10 includes a PCB substrate 11, and a first radiating portion 100 and a second radiating portion 200 that are provided on the PCB substrate 11.

Figure 1:
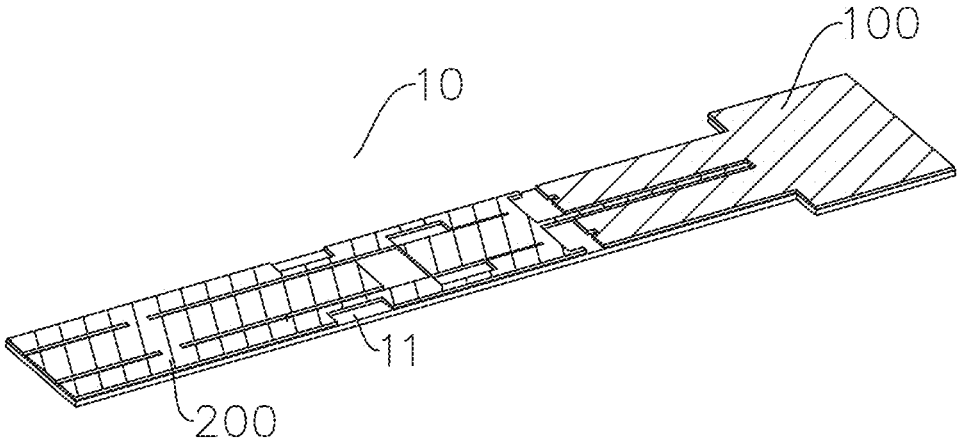
FIG. 1 is a schematic perspective diagram of a PCB antenna in accordance with an embodiment of the present invention.

In a preferred embodiment, as shown in FIG. 1, the PCB substrate 11 has a size of 124.65 mm×27.02 mm and a thickness of 0.8 mm. The PCB substrate has a small volume and occupies little space in a terminal device.

Further, the first radiating portion 100 and the second radiating portion 200 are arranged opposite to each other and not directly connected to each other with a slot therebetween.

The first radiating portion 100 includes a first radiator 101, and a second radiator 102 and a third radiator 103 that extend from the first radiator 101. The second radiator 102 and the third radiator 103 are arranged symmetrically with respect to an axis 500 of the first radiator 101 in a first direction 401. A feeding groove 301 is formed between the second radiator 102 and the third radiator 103. The first direction 401 is an extending direction of the second radiator 102 relative to the first radiator 101. Sides of the second radiator 102 and the third radiator 103 opposite to those connected to the first radiator 101 are provided with a first opening 1001 and a second opening 1002, respectively.

For convenience of description, in the present invention, the first direction 401 is set to a right-to-left direction of the horizontal direction, and a direction opposite to the first direction is a left-to-right direction of the horizontal direction.

Figure 2:
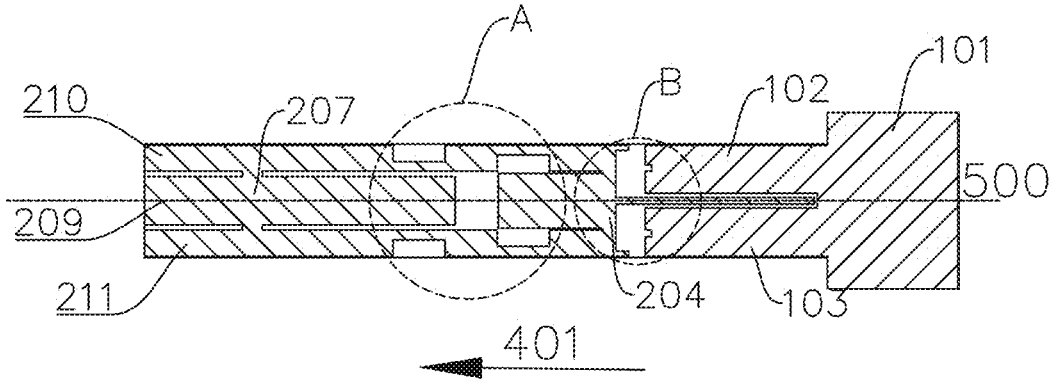
FIG. 2 is a schematic plan diagram of a PCB antenna in accordance with an embodiment of the present invention.
Figure 3:
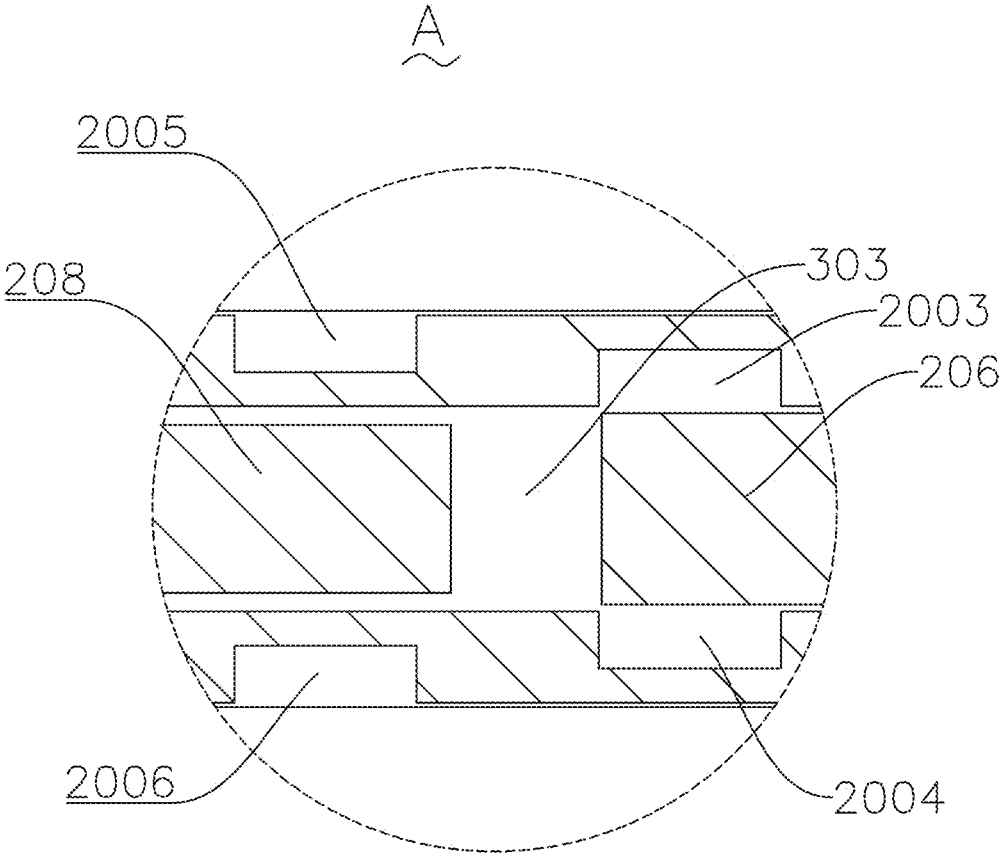
FIG. 3 is a partially enlarged schematic diagram of a PCB antenna in accordance with an embodiment of the present invention.
Figure 4:
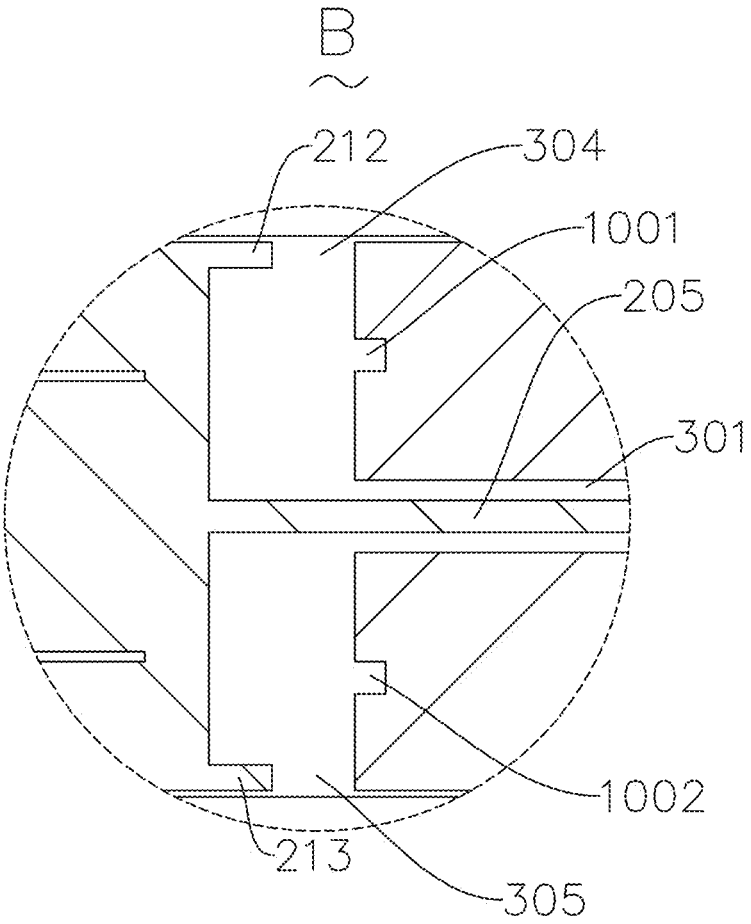
FIG. 4 is a partially enlarged schematic diagram of a PCB antenna in accordance with an embodiment of the present invention.

That is, as shown in FIGS. 2-4, the second radiator 102 and the third radiator 103 are provided on a left side of the first radiator 101. The second radiator 102 and the third radiator 103 are formed by extending from the left side of the first radiator 101 and extending a certain length from left to right in the horizontal direction. The second radiator 102 and the third radiator 103 are symmetrically arranged with respect to the axis of the first radiator 101 in the horizontal direction and form a slot therebetween, and the slot is the feeding groove 301. A first opening 1001 is provided on a left side of the second radiator 102, and a second opening 1002 is provided on a left side of the third radiator 103. The first opening 1001 and the second opening 1002 are symmetrically arranged with respect to the axis 500 of the first radiator 101 in the horizontal direction, and the openings have the same size.

As shown in FIGS. 2-4, the second radiating portion 200 includes a fourth radiator 204, and a fifth radiator 205 and a sixth radiator 206 that extend from the fourth radiator 204 in the horizontal direction. The fifth radiator 205 extends rightward to the feeding groove 301 and forms a first slot 302 with the first radiator 101. The sixth radiator 206 extends leftward from the fourth radiator 204.

The second radiating portion 200 further includes a seventh radiator 207, and an eighth radiator 208 and a ninth radiator 209 that extend from the seventh radiator 207 in the horizontal direction. The seventh radiator 207 extends in a direction of the sixth radiator 206 (that is, horizontally rightward) and forms a second slot 303 with the sixth radiator 206. The eighth radiator 208 extends in an opposite direction of the seventh radiator 207 (that is, horizontally leftward).

The second radiating portion 200 further includes a tenth radiator 210 and an eleventh radiator 211 that extend from a side of the fourth radiator 207 close to the second radiator and beyond the seventh radiator 207 and are symmetrically arranged with respect to the axis of the first radiator 101 in the horizontal direction. That is to say, right sides (sides close to the first radiator 101) of the tenth radiator 210 and the eleventh radiator 211 are aligned with and a right side (a side close the first radiator 101) of the fourth radiator 204. The tenth radiator 210 and the eleventh radiator 211 are both connected to the fourth radiator 204 and the seventh radiator 207, the tenth radiator 210 and the eleventh radiator 211 both extend leftward to a position of the ninth radiator 209, and left sides (a side facing away from the first radiating portion) of the tenth radiator 210 and the eleventh radiator 211 are aligned with a left side (the side facing away from the first radiating portion) of the ninth radiator 209.

Further, the second radiating portion 200 further includes a twelfth radiator 212 extending from the tenth radiator 210 in the direction opposite to the first direction 401, and a thirteenth radiator 213 extending from the eleventh radiator 211 in the direction opposite to the first direction 401. The twelfth radiator 212 and the thirteenth radiator 213 are arranged symmetrically with respect to the axis of the first radiator 101 in the horizontal direction. In addition, an upper side (a side facing away from the thirteenth radiator 213) of the twelfth radiator 212 is aligned with an upper side (a side facing away from the eleventh radiator 211) of the tenth radiator 210, and a lower side (a side facing away from the twelfth radiator 212) of the thirteenth radiator 213 is aligned with a lower side (a side facing away from the tenth radiator 210) of the eleventh radiator 211.

Moreover, the twelfth radiator 212 extends rightward to be close to the second radiator 102 and forms a third slot 304 with the second radiator 102. The thirteenth radiator 213 extends rightward to be close to the third radiator 103 and forms a fourth slot 305 with the third radiator 103.

Further, in the present invention, in order to enhance resonance performance of the PCB antenna in medium and high frequency bands, a width of the third slot 304 and a dimension of the fourth slot 305 in the horizontal direction are 2.3-2.7 mm and may be, for example, set to 2.5 mm, that is, a coupling distance between the first radiating portion 100 and the second radiating portion 200 may be set to 2.5 mm. Through a specific coupling distance, the resonance performance of the antenna in the medium and high frequency bands is enhanced, and the antenna performance is improved.

In another optional embodiment, referring to FIGS. 2-4, the tenth radiator 210 and the eleventh radiator 211 are respectively provided with a third opening 2003 and a fourth opening 2004 at sides close to the fifth radiator 205 and facing towards the sixth radiator 206, and the third opening 2003 and the fourth opening 2004 are arranged symmetrically with respect to the axis of the first radiator 101 in the horizontal direction. In addition, the tenth radiator 210 and the eleventh radiator 211 are respectively provided with a fifth opening 2005 and a sixth opening 2006 at sides facing away from the seventh radiator 207, and the fifth opening 2005 and the sixth opening 2006 are arranged symmetrically with respect to the axis of the first radiator 101 in the horizontal direction. The third opening 2003 and the fifth opening 2005 are provided on the tenth radiator 210, the fourth opening 2004 and the sixth opening 2006 are provided on the eleventh radiator 211, the third opening 2003 is on a right side of the fifth opening 2005, and the fourth opening 2004 is on a right side of the sixth opening 2006.

Further, left sides (sides close to the fifth opening 2005 and the sixth opening 2006) of the third opening 2003 and the fourth opening 2004 are aligned with a left side (a side facing away from the four radiator 204) of the sixth radiator 206.

That is to say, the radiators, openings, slots and grooves of the above PCB antenna are all arranged in the horizontal direction or in a vertical direction, and the use of vertical slots and grooves during processing can improve convenience and controllability during the processing of the PCB antenna. Moreover, the PCB antenna provided in the present invention has a compact structure, which can reduce requirements on the size of the PCB substrate, so as to ensure that the size of the PCB antenna is sufficiently small as a whole, thereby reducing space design requirements and volume design requirements on the antenna installed in the terminal device during the application process.

In a specific embodiment, the first radiator 101 has a dimension of 28 mm in the horizontal direction and has a dimension of 27.02 mm or 17.02 mm in the vertical direction. That is to say, upper and lower sides of the first radiator 101 may be aligned with an upper side of the second radiator 102 and a lower side of the third radiator 103, and may also exceed beyond the upper side of the second radiator 102 and the lower side of the third radiator 103, which can be specifically determined according to the size of the PCB substrate and a size of a special position where the PCB antenna is installed.

In an alternative embodiment, the second radiator 102 has a dimension of 7.38-7.39 mm in the vertical direction. The feeding groove 301 has dimension of 2.25 mm in the vertical direction. A slot width of the first slot 302 is 2.25 mm, and a dimension of the fifth radiator 205 in a direction perpendicular to the first direction 401 is 1 mm.

The first opening 1001 and the second opening 1002 have opening sizes of 1 mm (dimensions in the vertical direction) and are located in middle position on the left side of the second radiator 102 and the third radiator 103. That is, the axis of the first opening 1001 in the horizontal direction coincides with the axis of the second radiator 102 in the horizontal direction.

A dimension of the fifth radiator 205 in the vertical direction is smaller than a dimension of the sixth radiator 206 in the vertical direction, the dimension of the sixth radiator 206 in the vertical direction is larger than dimensions of the eighth radiator 208 and the ninth radiator 209 in the vertical direction, and the eighth radiator 208 and the ninth radiator 209 have the same dimension in the vertical direction. The dimension of the sixth radiator 206 in the vertical direction is 8.02 mm, and the dimensions of the eighth radiator 208 and the ninth radiator 209 in the vertical direction are both 7.02 mm.

A dimension of the fourth radiator 204 in the horizontal direction is larger than a dimension of the seventh radiator 207 in the horizontal direction. A dimension of the sixth radiator 206 in the horizontal direction is 16 mm.

Dimensions of the tenth radiator 210 and the eleventh radiator 211 in the vertical direction are both 4 mm.

The twelfth radiator 212 and the thirteenth radiator 213 both have dimensions of 2 mm in the horizontal direction and dimensions of 1 mm in the vertical direction.

The dimensions of the third opening 2003 and the fourth opening 2004 in the horizontal direction are smaller than the dimensions of the fifth opening 2005 and the sixth opening 2006 in the horizontal direction. The dimensions of the third opening 2003 and the fourth opening 2004 in the horizontal direction are 3 mm in width. The dimensions of the fifth opening 2005 and the sixth opening 2006 in the horizontal direction are 8 mm. The dimensions of the third opening 2003, the fourth opening 2004, the fifth opening 2005, and the sixth opening 2006 in the vertical direction are 2.5 mm.

In the present invention, the aforementioned PCB antenna 10 cooperates between the plurality of radiators included in the first radiating portion 100 and the plurality of radiators included in the second radiating portion 200, to at least coordinately realize resonance in the 5G and Sub6G frequency bands. Specifically, operating frequency bands of the first radiator 101 and the tenth radiator 210 are 790-960 MHz; operating frequency bands of the third radiator 103 and the eighth radiator 208 are 1710-2690 MHz; an operating frequency band of the sixth radiator 206 is 3.3-3.6 GHz; the operating frequency band of the eighth radiator 208 is 4.8-5.0 GHz. In other words, the PCB antenna 10 can at least achieve resonance in the frequency bands of 790-960 MHz, 1710-2690 MHz, 3.3-3.6 GHz, and 4.8-5 GHz under the 5G and Sub6G frequency bands.

Further, the PCB antenna 10 further includes a feeder port 600 provided at the first slot 302. The feeder port 600 includes one end connected to the first radiator 101 and the other end connected to the fifth radiator 205, and a power-feeding manner of the feeder port 600 may be coaxial power-feeding.

Figure 5:
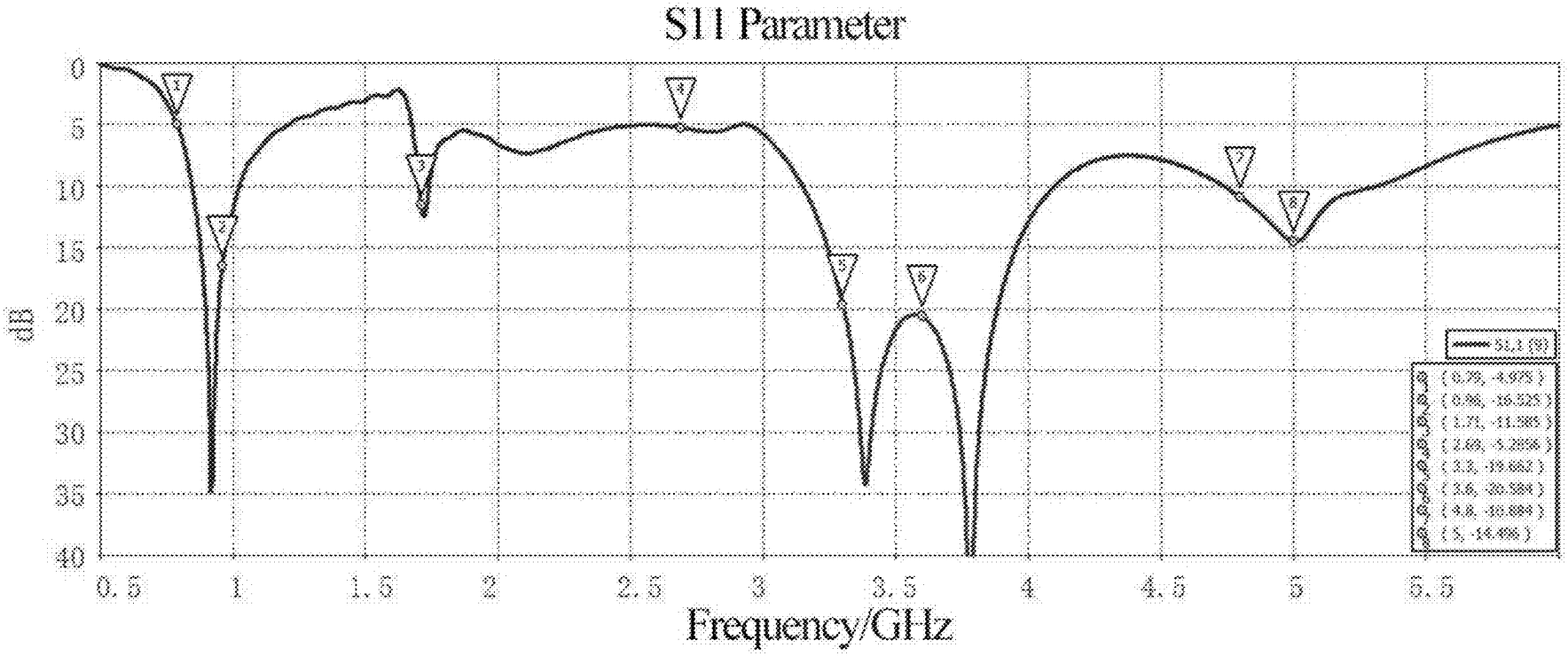
FIG. 5 shows a return loss curve of a PCB antenna during operation in accordance with an embodiment of the present invention.
Figure 6:
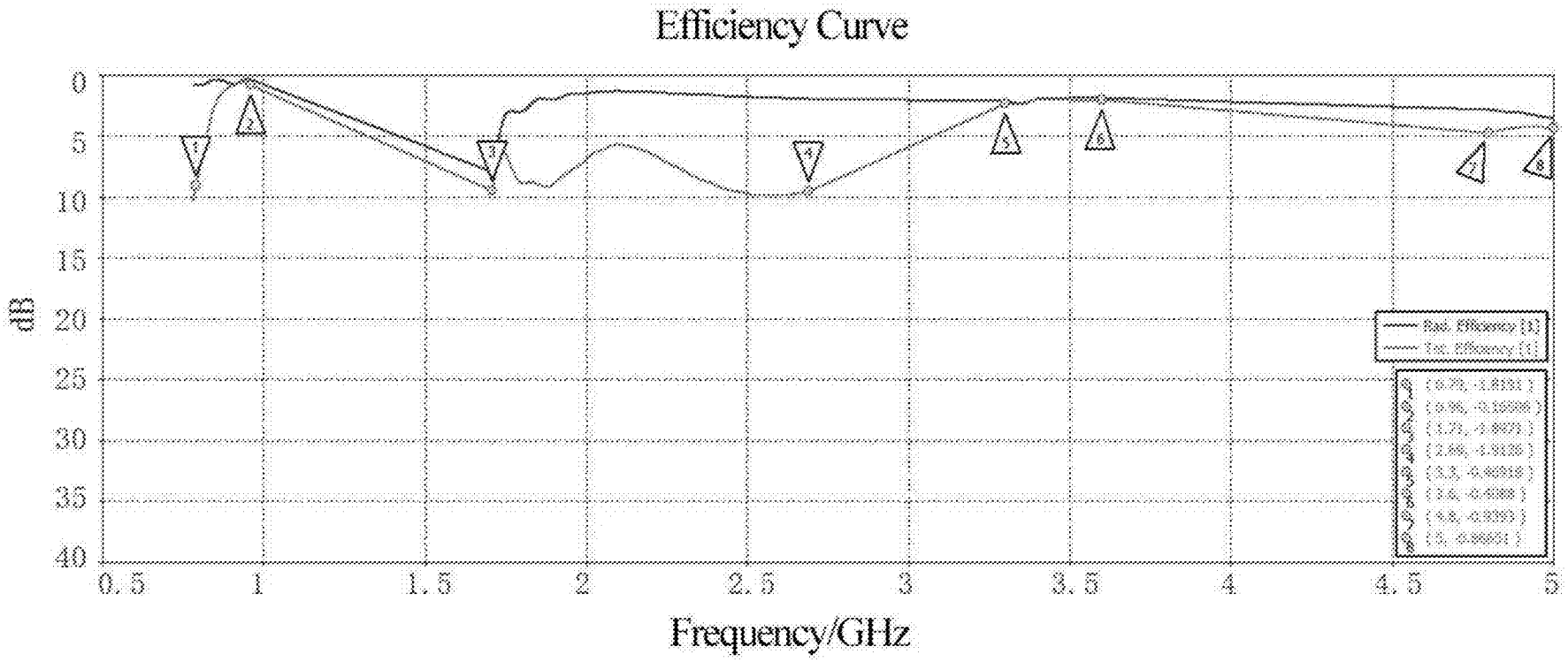
FIG. 6 shows efficiency curves of a PCB antenna during operation in accordance with an embodiment of the present invention.
Figure 7:
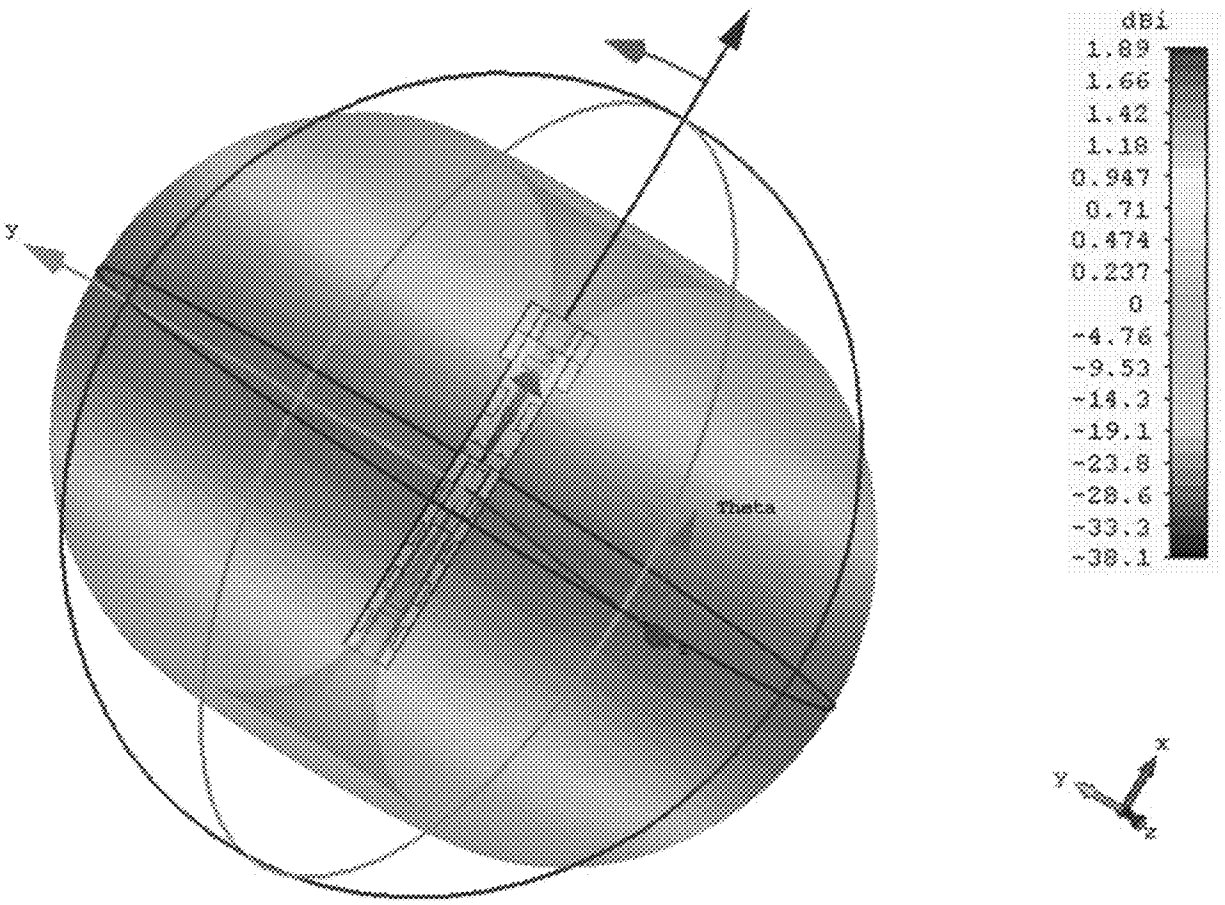
FIG. 7 shows a pattern of a PCB antenna at 900 MHz in accordance with an embodiment of the present invention.
Figure 8:
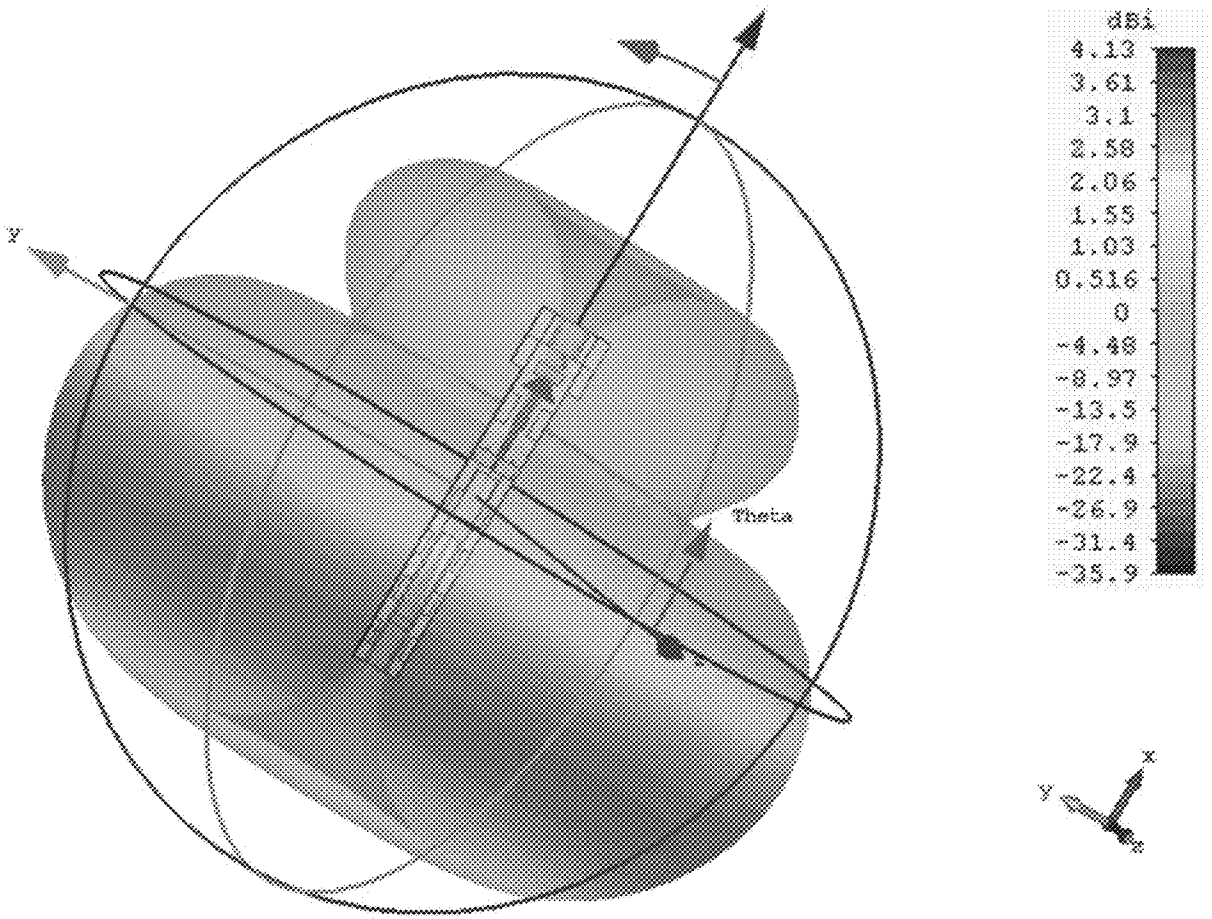
FIG. 8 shows a pattern of a PCB antenna at 2.01 GHz in accordance with an embodiment of the present invention.
Figure 9:
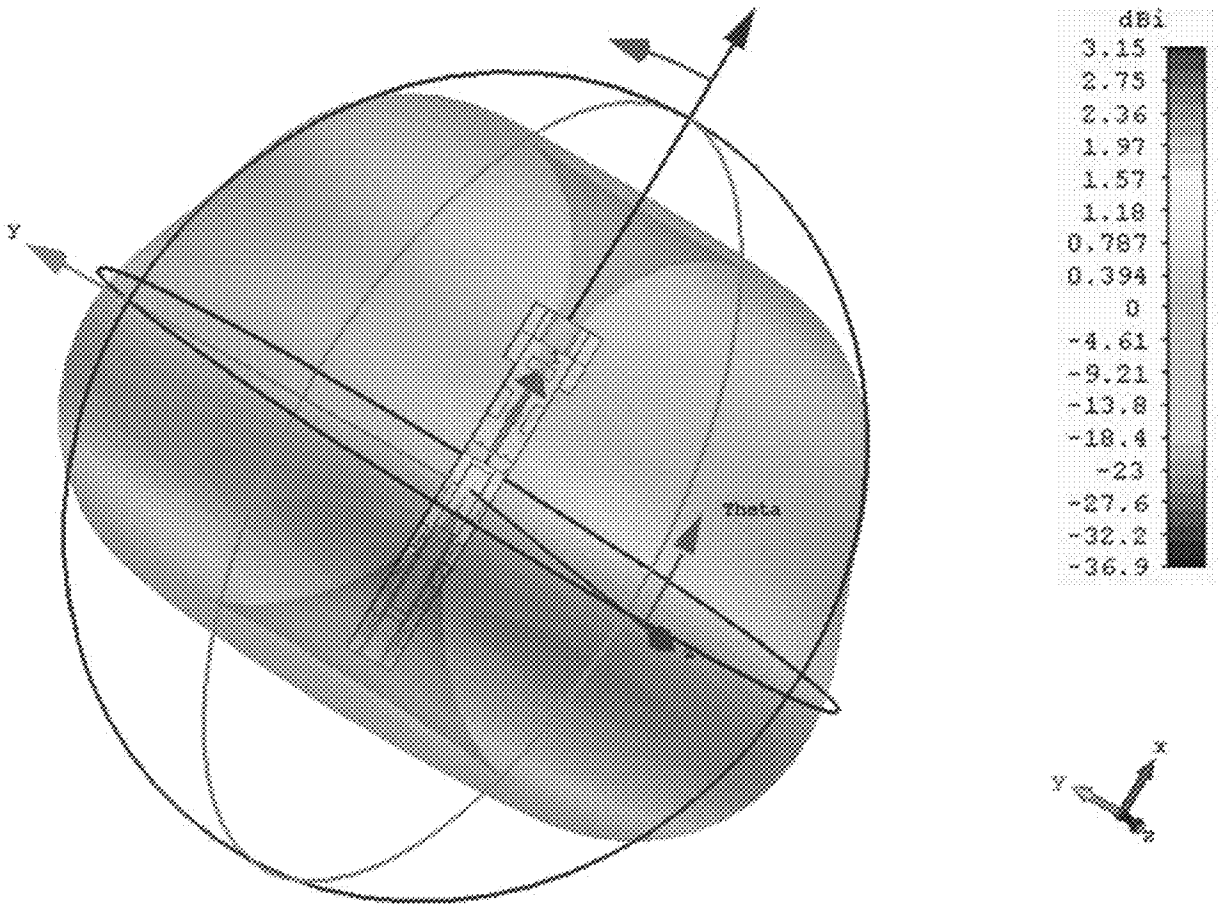
FIG. 9 shows a pattern of a PCB antenna at 2.61 GHz in accordance with an embodiment of the present invention.
Figure 10:
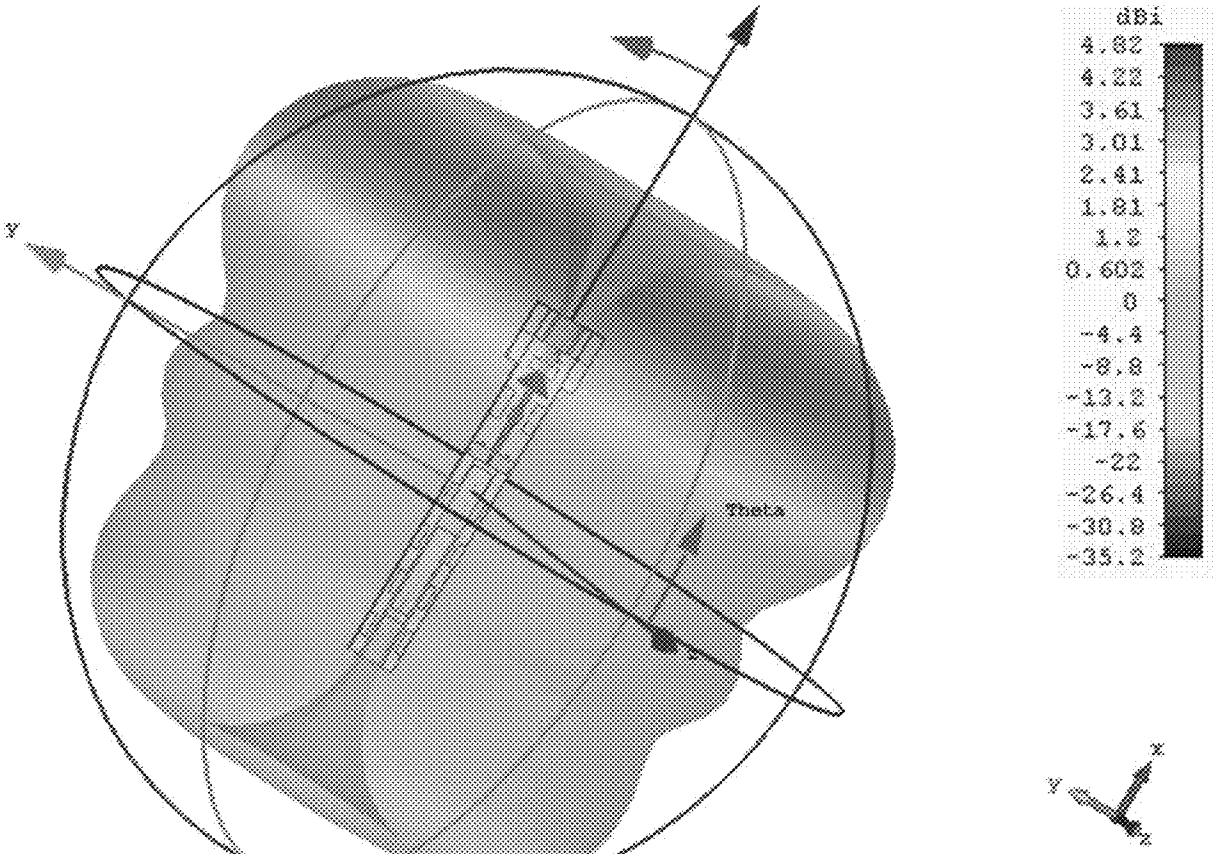
FIG. 10 shows a pattern of a PCB antenna at 3.45 GHz in accordance with an embodiment of the present invention.
Figure 11:
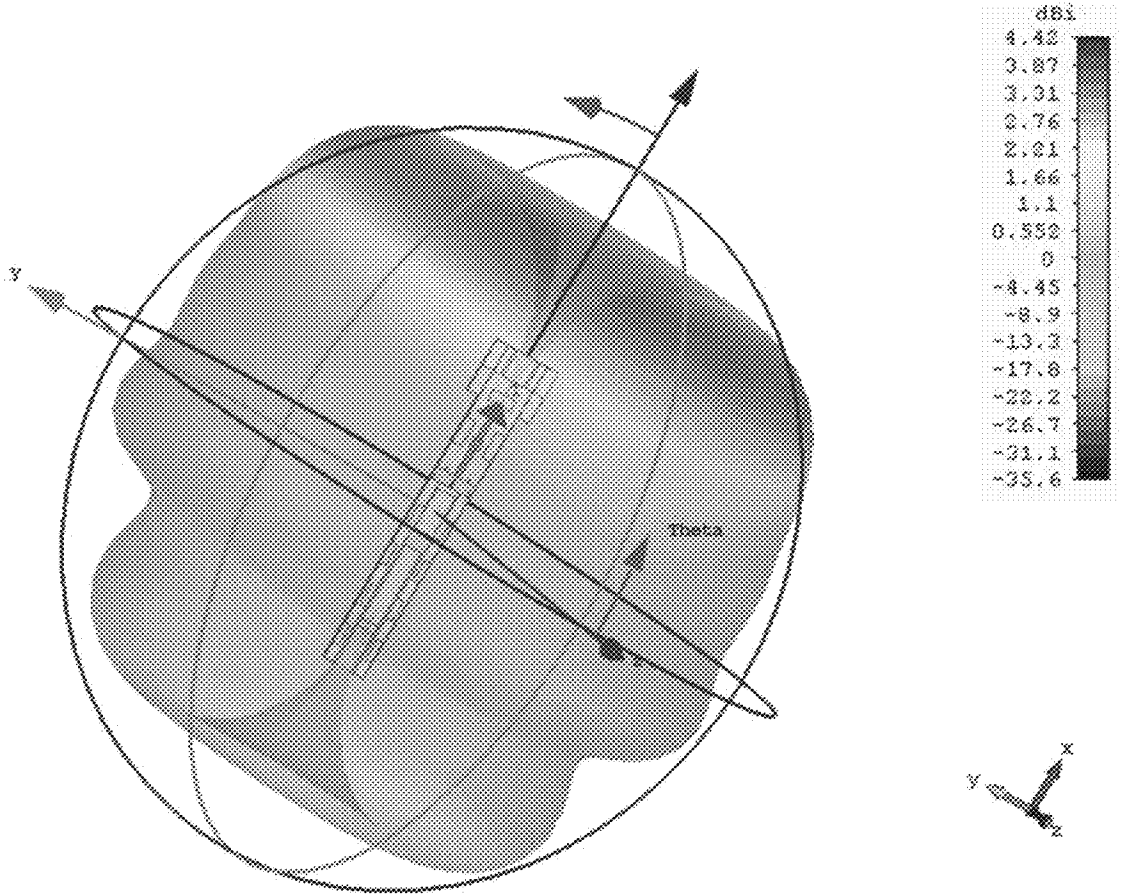
FIG. 11 shows a pattern of a PCB antenna at 4.9 GHz in accordance with an embodiment of the present invention.

As shown in FIG. 5 and FIG. 6, return loss and an efficiency curve of the PCB antenna provided in the present invention during operation are shown, respectively.

As shown in FIGS. 7-11, patterns of the PCB antennas provided in the present invention at frequencies of 900 MHz, 2.01 GHz, 2.61 GHz, 3.45 GHz, and 4.9 GHz are shown, respectively.

Adopting the PCB antenna provided by the present invention, signal radiation of multiple frequency bands under the frequency bands of 5G and Sub6G can be achieved through the radiation between the plurality of radiators, adopting horizontal or vertical radiator arrangement and slots and grooves when arranging the radiators improves the convenience of the PCB antenna in the processing process, and adopting the compact structure arrangement reduces the overall size of the PCB antenna and reduces demand for an antenna area. In addition, through the coupling between the third slot and the fourth slot, the resonance performance of the PCB antenna at medium and high frequencies is enhanced, to improve the antenna performance and realize the signal radiation under the frequency bands of 5G and Sub6G.

It should be noted that, the above are merely embodiments of the present invention, those skilled in the art can make improvements without departing from the inventive concept of the present invention, however, these improvements shall fall into the protection scope of the present invention.

What is claimed is:

1. A PCB antenna, comprising:

a PCB substrate;

a first radiating portion provided on the PCB substrate; and a second radiating portion provided on the PCB substrate, wherein the first radiating portion comprises a first radiator, a second radiator extending from the first radiator and a third radiator extending from the first radiator, the second radiator and the third radiator are arranged symmetrically with respect to an axis of the first radiator in a first direction, a feeding groove is formed between the second radiator and the third radiator, and the first direction is a direction in which the second radiator extends relative to the first radiator; a side of the second radiator facing away from the first radiator is provided with a first opening, and a side of the third radiator facing away from the first radiator is provided with a second opening;

the second radiating portion comprises a fourth radiator, a fifth radiator extending from the fourth radiator and a sixth radiator extending from the fourth radiator, and the fifth radiator extends to the feeding groove, and a first slot is formed between the fifth radiator and the first radiator; and the sixth radiator extends in a direction opposite to a direction in which the fifth radiator extends;

the second radiating portion further comprises a seventh radiator, an eighth radiator extending from the seventh radiator and a ninth radiator extending from the seventh radiator, the seventh radiator extends in the direction in which the sixth radiator extends, and a second slot is formed between the seventh radiator and the sixth radiator; and the eighth radiator extends in a direction opposite to the direction in which the seventh radiator extends;

the second radiating portion further comprises a tenth radiator and an eleventh radiator that extend from a side of the fourth radiator close to the second radiator and beyond the seventh radiator and are symmetrically arranged with respect to the axis of the first radiator in the first direction, and the tenth radiator and the eleventh radiator are connected to the fourth radiator and the seventh radiator; and the second radiator further comprises a twelfth radiator extending from the tenth radiator in a direction opposite to the first direction, and a thirteenth radiator extending from the eleventh radiator in the direction opposite to the first direction; and a third slot is formed between the twelfth radiator and the second radiator, and a fourth slot is formed between the thirteenth radiator and the third radiator.

2. The PCB antenna as described in claim 1, wherein a width of the third slot and a width of the fourth slot both range from 2.2 mm to 2.7 mm.

3. The PCB antenna as described in claim 1, wherein operating frequency bands of the PCB antenna are 790-960 MHz, 1710-2690 MHz, 3.3-3.6 GHz and 4.8-5 GHz.

4. The PCB antenna as described in claim 1, wherein a third opening is provided at a side of the tenth radiator close to the fifth radiator and facing towards the sixth radiator, and a fourth opening is provided at a side of the eleventh radiator close to the fifth radiator and facing towards the sixth radiator, and sides of the third opening and the fourth opening away from the first radiator are aligned with a side of the sixth radiator facing away from the fifth radiator; and a fifth opening is provided at a side of the tenth radiator facing away from the seventh radiator, and a sixth opening is provided at a side of the eleventh radiator facing away from the seventh radiator.

5. The PCB antenna as described in claim 1, further comprising a feeder port provided in the first slot.

6. The PCB antenna as described in claim 5, wherein the feeder port comprises one end connected to the first radiator and the other end connected to the fifth radiator.

7. The PCB antenna as described in claim 6, wherein the feeder port is a coaxial feeder port.

8. The PCB antenna as described in claim 6, wherein a size of the PCB substrate is 124.65 mm×27.02 mm.

9. The PCB antenna as described in claim 5, wherein the feeder port is a coaxial feeder port.

10. The PCB antenna as described in claim 5, wherein a size of the PCB substrate is 124.65 mm×27.02 mm.

11. The PCB antenna as described in claim 1, wherein a slot width of the first slot is 2.25 mm, and a dimension of the fifth radiator in a direction perpendicular to the first direction is 1 mm.

12. The PCB antenna as described in claim 1, wherein a dimension of the fifth radiator in a direction perpendicular to the first direction is smaller than a dimension of the sixth radiator in the direction perpendicular to the first direction; a dimension of the sixth radiator in the direction perpendicular to the first direction is 8.02 mm; and dimensions of the eighth radiator and the ninth radiator in the first direction are 7.02 mm; and a dimension of the fourth radiator in the first direction is smaller than a dimension of the seventh radiator in the first direction.

* * * * *